US007806555B2

(12) United States Patent
Liu

(10) Patent No.: US 7,806,555 B2
(45) Date of Patent: Oct. 5, 2010

(54) POWER SUPPLY CONTROL DEVICE OF A FLASHLIGHT

(76) Inventor: Yun-Zhao Liu, No. 3, 2nd St., Hsinfeng Rd., Huangpu Township, Zhongshan City, Guangdong Province (CN)

( * ) Notice: Subject to any disclaimer, the term of this patent is extended or adjusted under 35 U.S.C. 154(b) by 366 days.

(21) Appl. No.: 12/081,325

(22) Filed: Apr. 15, 2008

(65) Prior Publication Data

US 2009/0257223 A1 Oct. 15, 2009

(51) Int. Cl.
*F21L 4/04* (2006.01)

(52) U.S. Cl. ..... 362/206; 362/204; 362/205; 362/202; 200/60

(58) Field of Classification Search ..... 362/202, 362/204, 205, 206, 190, 191, 184; 200/60
See application file for complete search history.

(56) References Cited

U.S. PATENT DOCUMENTS 4,339,788 A * 7/1982 White et al. ..... 362/157
4,580,198 A * 4/1986 Zinnanti, Jr. ..... 362/203
4,819,139 A * 4/1989 Thomas ..... 362/183
6,199,998 B1 * 3/2001 Hsiao ..... 362/119
2005/0128741 A1 * 6/2005 Matthews et al. ..... 362/206

* cited by examiner

*Primary Examiner*—Sandra L O'Shea
*Assistant Examiner*—Evan Dzierzynski
(74) *Attorney, Agent, or Firm*—Rosenberg, Klein & Lee

(57) ABSTRACT

A flashlight includes a body, a battery pack held in the body, a rear cover joined on the body, and a push-button switch in the rear cover; the push-button switch includes positive and negative electrodes, and a button part facing a through hole of the rear cover; the battery pack includes a casing, a battery set in the casing, and a socket facing a through hole of the casing; the battery pack includes positive and negative electrodes, which are connected to positive and negative electrodes of the socket; a first elastic component is positioned between and connected to the positive electrodes of the push-button switch and the battery pack; a second elastic component is positioned between and connected to the negative electrodes of the switch and the battery pack; the battery pack can be charged through a charger plugged in the socket while it is still held in the body.

6 Claims, 3 Drawing Sheets

POWER SUPPLY CONTROL DEVICE OF A FLASHLIGHT

BACKGROUND OF THE INVENTION

1. Field of the Invention

The present invention relates to a power supply control device of a flashlight, more particularly one, which includes a push-button switch held in a cover of a rear end of the flashlight, and which can be used with a battery pack comprising a socket and several batteries; the battery pack can be charged through a charger while it is still in the flashlight.

2. Brief Description of the Prior Art

A common flashlight includes a body, a front protecting member, and a rear cover. The flashlight body contains a battery set, and has a light emitting component on its front end, and a switch on its lateral side to control electric current to the light emitting component. The rear cover is joined on a rear end of the body to confine the battery set in the flashlight body. The front protecting member is joined on a front end of the flashlight body to protect the light emitting member. Because discarded batteries can cause pollution to the environment, chargeable batteries are getting popular, and they are very suitable for use with flashlights.

The above-mentioned battery set can be a single-part chargeable battery or a chargeable battery pack, which comprises several chargeable batteries connected together and fixed in a plastic casing. To charge the battery set, the battery set has to be first taken out of the flashlight body and put in a charger no matter if it is a single-part chargeable battery or if it is a battery pack. In other words, the battery set can't be charged through a charger while it is still held in the flashlight body. Therefore, such a chargeable battery set isn't convenient to use.

Furthermore, the charger has to be relatively large-sized to contain the battery set. Consequently, the material and manufacturing cost of the charger is relatively high.

Therefore, it is a main object of the present invention to provide a power supply control device of a flashlight to overcome the above problems.

SUMMARY OF THE INVENTION

A flashlight in accordance with an embodiment of the present invention includes a body, a battery pack held in the body, a rear cover joined on the body, and a push-button switch held in the rear cover to control electric current to a light source. The push-button switch includes positive and negative electrodes, and a button part covered with a rubber covering facing a through hole of the rear cover. The battery pack includes a casing, a battery set in the casing, a socket facing a hole of the casing, and positive and negative electrodes, which are connected to positive and negative electrodes of the socket respectively; a first elastic component is positioned between and electrically connected at two ends to the positive electrodes of the push-button switch and the battery pack while a second elastic component is positioned between and electrically connected at two ends to the negative electrodes of the push-button switch and the battery pack. The battery pack can be charged through a charger plugged in the socket while it is still held in the body.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
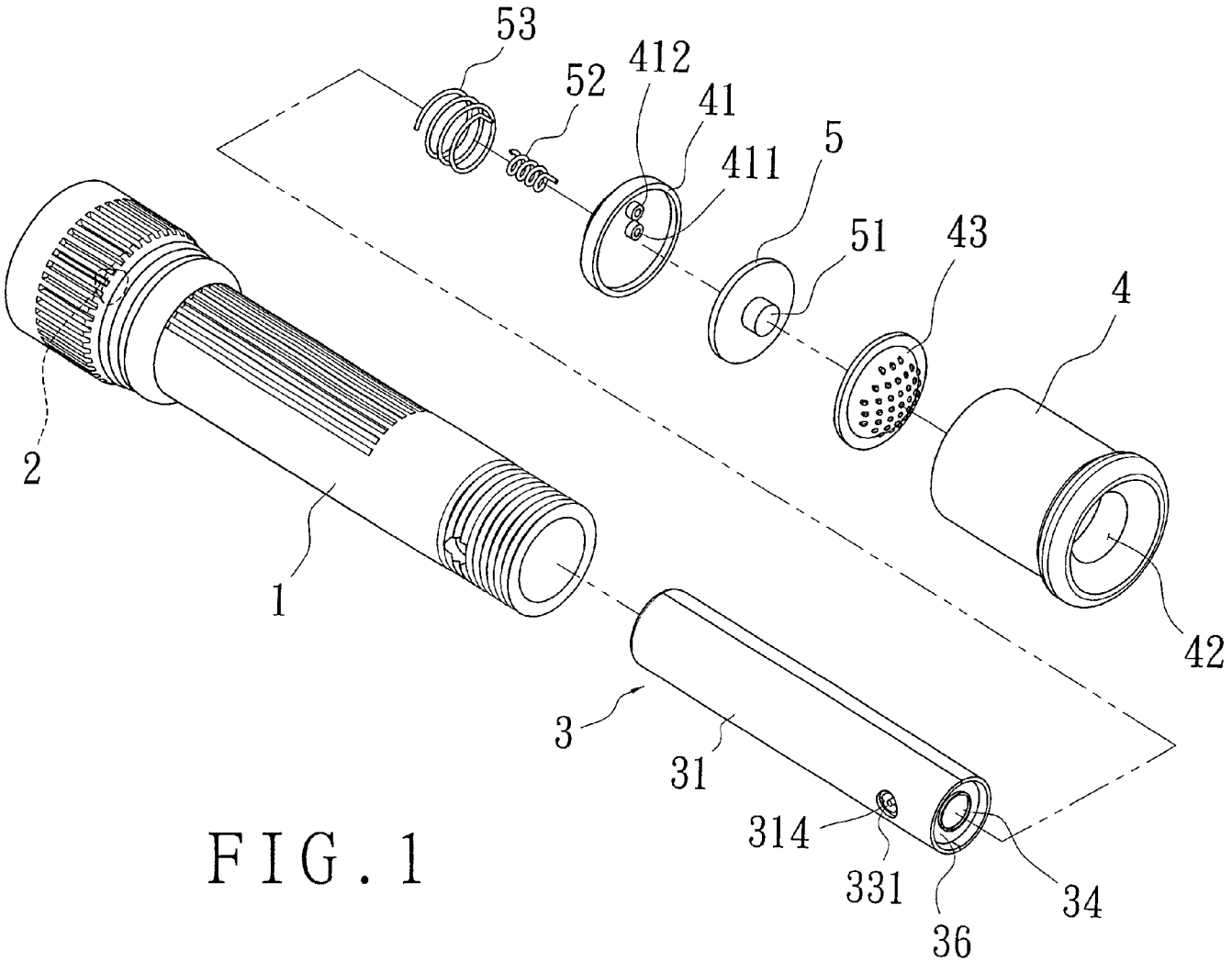
FIG. 1 is an exploded perspective view of the present invention.

Referring to FIG. 1, a preferred embodiment of a flashlight of the present invention consists of a flashlight body 1, a light source 2, a battery pack 3, a rear cover 4, and a push-button switch 5.

Figure 2:
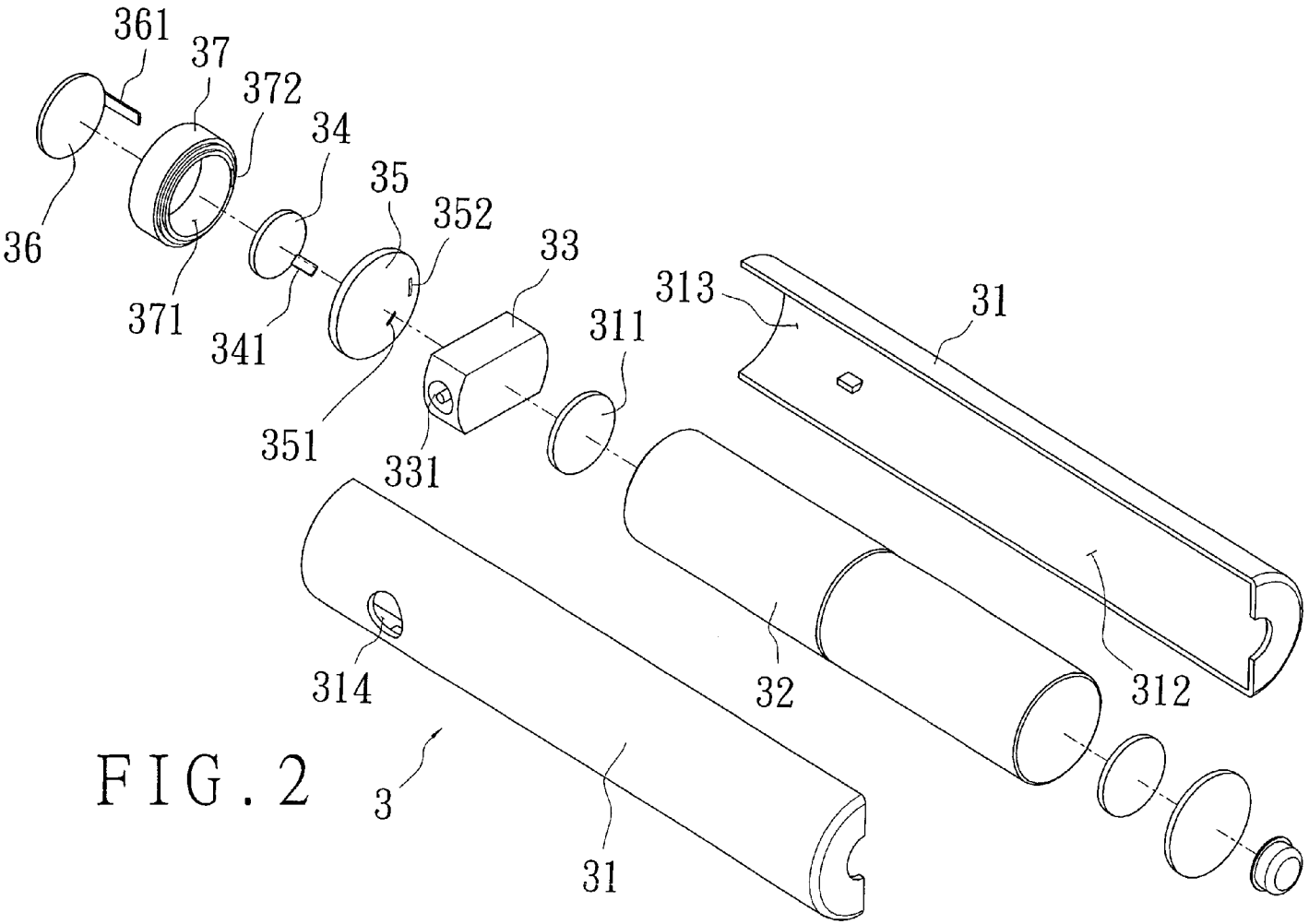
FIG. 2 is an exploded perspective view of the battery device of the present invention.

FIG. 2 is an exploded perspective view of the battery pack 3 in the present invention. The battery pack 3 includes a casing 31, which has a through hole 314. A separating part 311 is positioned in the casing 31 to divide an inside of the casing 31 into a battery holding room 312, and a socket holding room 313. The battery pack 3 includes a battery set 32, which is held in the battery holding room 312 of the casing 31; the battery set 32 can include single battery or several batteries connected in series. The battery pack 3 includes a socket 33, which is held in the socket holding room 313 of the casing 31, and has a socket hole 331 facing the through hole 314 of the casing 31. The battery pack 3 includes a positive electrode 34, a first electrode holder 35, a negative electrode 36, and a second electrode holder 37, which are positioned in a first end of the casing 31. The first electrode holder 35 has first and second square holes 351 and 352. The positive electrode 34 is round plate-shaped, and has a connecting plate part 341 protruding therefrom; the connecting plate part 341 is passed through the first square hole 351 of the first electrode holder 35, and connected to a positive electrode of the socket 33. The second electrode holder 37 is also ring-shaped, having a middle through hole 371, and a square hole 372 while the positive electrode 34 faces the middle through hole 371. The negative electrode 36 is ring-shaped, and has a connecting plate part 361 protruding therefrom; the connecting plate part 361 of the negative electrode 36 is passed through the square hole 372 of the second electrode holder 37 as well as the second square hole 352 of the first electrode holder 35, and connected to a negative electrode of the socket 33.

Figure 3:
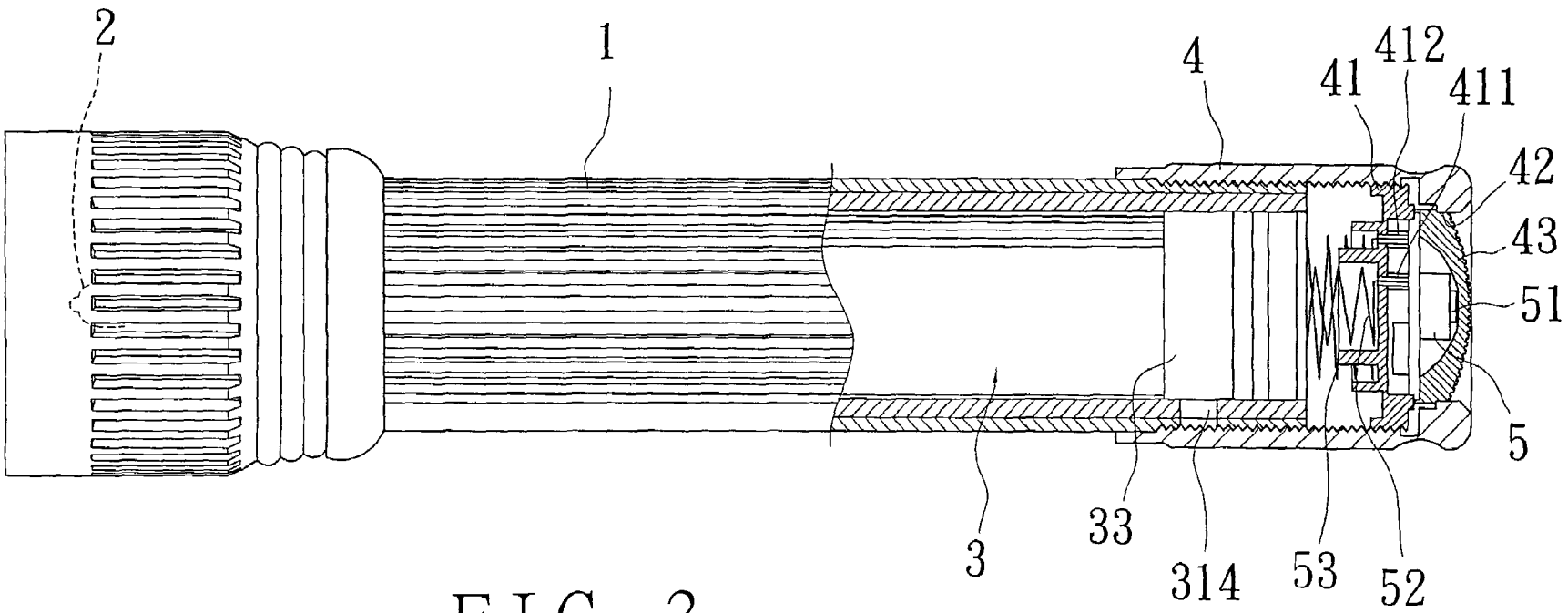
FIG. 3 is a partial sectional view of the present invention.

Referring to FIG. 3, in assembly, the rear cover 4 is threadedly joined on a rear end of the flashlight body 1, and the push-button switch 5 is positioned in the rear cover 4. A fixing piece 41 is contained in the rear cover 4 to fix the push-button switch 5 in position. The rear cover 4 has a through hole 42, and a rubber covering 43 is positioned on the through hole 42. The push-button switch 5 includes a button part 51, which is passed through the through hole 42 of the rear cover 4, and covered with the rubber covering 43. A first elastic component 52 is positioned between a positive electrode of the push-button switch 5 and the positive electrode 34 of the battery pack 3 while a second elastic component 53 is positioned between a negative electrode of the push-button switch 5 and the negative electrode 36 of the battery pack 3. The fixing piece 41 has first and second through holes 411 thereon, and one end of the first elastic component 52 is passed through the first through hole 411, and electrically connected to the positive electrode of the push-button switch 5 while one end of the second elastic component 53 is passed through the second through hole 411 of the fixing piece 41, and electrically connected to the negative electrode of the push-button switch 5. The other ends of the first and the second elastic components 52 and 53 are directly connected to the positive and the negative electrodes 34 and 36 of the battery pack 3.

Therefore, one can turn on of turn off the flashlight by means of pressing the button part 51 of the push-button switch 5 so as to control electric current to the light source 2. One can gain access to the through hole 314 of the casing 31 of the battery pack 3, and insert a plug of a charger into the socket hole 331 of the socket 33 through the through hole 314 of the casing 31 to charge the battery pack 3 after he/she loosens the rear cover 4 so as to uncover the through hole 314.

From the above description, it can be seen that the present invention has the following advantages:

The user can turn on or turn off the flashlight merely by means of pressing the button part of the push-button switch. The battery pack doesn't have to taken out of the flashlight body to be charged, and in turn the charger doesn't have to be very large-sized with a holding room therein to hold the battery pack. Therefore, the present invention is practical and convenient to use.

What is claimed is:

1. A power supply control device of a flashlight, the flashlight comprising:

(a) a flashlight body;

(b) a rear cover joined on a rear end of the flashlight body; the rear cover having a through hole;

(c) a push-button switch fixedly positioned in the rear cover; the push-button switch including a button part passed through the through hole of the rear cover; the push-button switch including positive and negative electrodes; and (d) a battery pack held in the flashlight body; the battery pack including:

a casing; the casing being divided into a battery holding room, and a socket holding room;

a battery set held in the battery holding room of the casing;

a socket held in the socket holding room of the casing; the socket having a socket hole facing a through hole of the casing; the socket including positive and negative electrodes;

a positive electrode; the positive electrode being positioned in a first end of the casing, and held in position with a first electrode holder; the positive electrode having a connecting plate part, which is passed through the first electrode holder, and connected to the positive electrode of the socket;

a negative electrode; the negative electrode being positioned in the first end of the casing, and held in position with a second electrode holder; the negative electrode having a connecting plate part, which is passed through the second electrode holder, and connected to the negative electrode of the socket;

a first elastic component being positioned between and electrically connected at two ends thereof to the positive electrodes of the push-button switch and the battery pack;

a second elastic component being positioned between and electrically connected at two ends thereof to the negative electrodes of the push-button switch and the battery pack.

2. The power supply control device of a flashlight as claimed in claim 1, wherein the battery pack includes single battery.

3. The power supply control device of a flashlight as claimed in claim 1, wherein the battery pack includes a plurality of batteries connected in series.

4. The power supply control device of a flashlight as claimed in claim 1, wherein the positive electrode of the battery pack is round plate-shaped, and the first electrode holder has first and second square holes thereon, and the second electrode holder has a square hole, and a middle through hole facing the positive electrode of the battery pack;

the connecting plate part of the positive electrode of the battery pack being passed through the first square hole of the first electrode holder connected to the positive electrode of the socket;

the negative electrode and the second electrode holder of the battery pack being ring-shaped; the negative electrode of the battery pack having a connecting plate part;

the connecting plate part of the negative electrode being passed through the square hole of the second electrode holder as well as the second square hole of the first electrode holder, and connected to the negative electrode of the socket.

5. The power supply control device of a flashlight as claimed in claim 1 further comprising a rubber covering; the rubber covering being positioned on the through hole of the rear cover to cover the button part of the push-button switch.

6. The power supply control device of a flashlight as claimed in claim 1, wherein a fixing piece is positioned in the rear cover to hold the push-button switch in position; the first end of the first elastic component being passed through the fixing piece and electrically connected to the positive electrode of the push-button switch; the first end of the second elastic component being passed through the fixing piece and electrically connected to the negative electrode of the push-button switch.

* * * * *